United States Patent [19]

Halls et al.

[11] 4,191,589

[45] Mar. 4, 1980

[54] METHOD AND APPARATUS FOR CLEANING CARPETS AND SURFACES USING CLEANING FLUID

[75] Inventors: Kenneth F. Halls; Robert R. Gibbons, both of Denver, Colo.

[73] Assignee: The John J. Sundheim Family Estate, Englewood, Colo. ; a part interest

[21] Appl. No.: 790,592

[22] Filed: Apr. 25, 1977

[51] Int. Cl.[2] ..... B08B 5/04

[52] U.S. Cl. ..... 134/21; 15/50 R; 15/322; 134/34; 134/102; 134/176; 239/251

[58] Field of Search ..... 134/21, 34, 37, 102, 134/176, 179, 180, 181; 15/50 R, 320, 321, 322; 239/258, 247, 1, 286, 287, 225, 251; 401/289

[56] References Cited

U.S. PATENT DOCUMENTS

| | | | |
|---|---|---|---|
| 2,588,000 | 3/1952 | Hines | 15/320 |
| 3,619,849 | 11/1971 | Jones | 15/321 |
| 3,748,050 | 7/1973 | Poppitz | 15/50 R |
| 3,774,262 | 11/1973 | Anthony et al. | 15/322 |
| 3,829,019 | 8/1974 | Petsch | 15/50 R |
| 3,832,069 | 8/1974 | Petsch | 15/50 R |
| 3,919,729 | 11/1975 | Cannon | 134/21 |
| 4,000,538 | 1/1977 | Tissier | 15/320 |

*Primary Examiner*—S. Leon Bashore
*Assistant Examiner*—George C. Yeung
*Attorney, Agent, or Firm*—Burton & Dorr

[57] ABSTRACT

A method and apparatus for cleaning a surface using a high velocity stream or streams of cleaning fluid. The high velocity stream or streams issue from one or more nozzles that are moving at a high velocity relative to the surface to be cleaned. In a preferred embodiment, three nozzles are mounted to a common hub member with two of the nozzles directed at the carpet so that they tend to move the hub member in a first direction about the axis of rotation. The third nozzle is directed at the carpet so that it tends to move the hub member about the axis of rotation in a second direction opposite to the first. The first two nozzles determine the direction of rotation and the third nozzle is then moved relative to the surface so that the velocity imparted to the stream issuing from the third nozzle because of its motion adds to the existing velocity of the stream due to the high pressure alone of the source of the cleaning fluid. This embodiment has been found to work particularly well on carpets.

2 Claims, 6 Drawing Figures

METHOD AND APPARATUS FOR CLEANING CARPETS AND SURFACES USING CLEANING FLUID

FIELD OF THE INVENTION

This invention relates to a method and apparatus for cleaning hard and soft surfaces such as carpets, floors, streets and the like with a cleaning fluid.

BACKGROUND OF THE INVENTION

Past methods and apparatuses for cleaning surfaces such as carpets have primarily relied upon the technique of applying a cleaning fluid to the carpet and then scrubbing the carpet with mechanical devices such as brushes. In this general technique, the cleaning fluid can be applied directly to the carpet as in the case of U.S. Pat. No. 1,821,715 to Kuchinsky, issued Sept., 1931, or can be applied indirectly to the carpet by having the fluid flow through the scrubbing brushes onto the carpet as illustrated in U.S. Pat. No. 2,168,692 to Videl, issued Aug. 8, 1939, 1,176,990 to Scherff, issued Mar. 28, 1916, and 3,189,930 to Tuthill, Jr., issued June 22, 1965. A variation of the technique is to apply the cleaning fluid to the carpet both directly and through the brushes as done in U.S. Pat. No. 2,250,177 to Boccasile, issued July 22, 1941. Another variation is to apply the cleaning fluid directly to the carpet through a rotating, hollow scrubbing member as illustrated by U.S. Pat. No. 1,498,255 to Winchester, issued June 17, 1924. The cleaning fluid in such devices is usually fed under low pressure of about 30 to 50 pounds per square inch or by gravity and the actual loosening of the soiling material in or on the carpet is done by the mechanical scrubbing device. Apparatuses that use mechanical scrubbing devices are often bulky and heavy, making them difficult to maneuver and causing them to leave the carpet fibers in a depressed condition. Further, these cleaners have a tendency to rub the soiling material or dirt into the base of the fibers of the carpet rather than remove it from the fibers. The scrubbers in such cleaners generally agitate the carpet and cleaning fluid to create a foam. During this shampooing operation, soiling material in the rug settles down in the piles of the carpet and little of it is removed. After a carpet has been shampooed several times, it reaches a state in which the build-up of residue left from the shampoo itself and the soiling material is so great that shampooing is no longer effective. Further, such cleaners tend to produce a grinding effect in which the fibers of the carpet are pressed against dirt particles and are actually ground up.

Another technique for cleaning carpets is to apply jets or streams of cleaning fluid to the carpet and then remove the cleaning fluid and soiling material from the carpet through a vacuum nozzle. The force of the fluid jet or stream impinging on the carpet loosens the soiling material or dirt. A significant advantage of a cleaner of this type which utilizes a jet of cleaning fluid and a vacuum nozzle is that it removes the soiling material from the carpet rather than merely moving the soiling material down within the piles as happens in shampooing cleaners. Examples of this general technique are U.S. Pat. No. 3,744,262 to Anthony, issued Nov. 27, 1973, 3,614,797 to Jones issued Oct. 26, 1971; 3,431,582 to Grave issued Mar. 11, 1969: 3,605,169 to Howerin issued Sept. 20, 1971, and 3,619,849 to Jones issued Nov. 16, 1971, which supply fluid under pressure to fixed nozzles. U.S. Pat. No. 2,660,744 to Cockrell, issued Dec. 1, 1953, supplies water under pressure to rotatably mounted nozzles which are rotated about a fixed axis by the reaction force of the jets or streams issuing from the nozzles. U.S. Pat. Nos. 2,003,216 to Nadig issued May 28, 1935 and 2,223,963 to Nadig issued Dec. 3, 1940 use a rotary distributor to draw liquid from a source under ambient pressure and to impel the liquid onto the surface to be cleaned. U.S. Pat. No. 3,624,668 to Krause issued Nov. 30, 1971, applies cleaning fluid through moving nozzles directed vertically downward toward the carpet. Krause rotates his vacuum pick up with his cleaning fluid applicators and immediately vacuums the carpet after the cleaning fluid is applied.

SUMMARY OF THE INVENTION

This invention provides a new and novel method and apparatus for cleaning hard and soft surfaces such as carpets, floors, streets, and the like through the use of a cleaning fluid. In this invention, a cleaning fluid such as air, water, water containing detergents or other cleaning material, and the like is placed under high pressure and impinged in a stream through a nozzle at a high velocity against the surface to be cleaned. The nozzle is mounted for rotation about an axis substantially perpendicular to the surface and directed at the surface at an inclined angle so that the high velocity stream issuing from the nozzle propels it about the axis of rotation at a high velocity. One or more nozzles can be located on one or more arms and inclined to the surface to be cleaned so that the stream issuing from each nozzle propels it about the axis of rotation. The nozzles are located on a floor tool that is moved over the surface to move the axis of rotation of the nozzles relative to the surface. In a preferred embodiment, there are three arms extending outwardly of a hub member with each having a nozzle inclined to the surface so that the streams issuing from two of the nozzles tend to rotate the hub member about the axis of rotation in one direction and the stream issuing from the third nozzle tends to rotate the hub member in the opposite direction about the axis of rotation. The first two nozzles determine the direction of rotation and the third nozzle serves to reduce and control the number of revolutions per minute of the three nozzles about the axis. The third nozzle is driven by the other two about the axis in a direction against the reaction force of the stream issuing from it and is a superior cleaning nozzle. The invention also includes a vacuum pick up system and wall nozzles to enable the apparatus to clean near walls or the edge of the carpet.

The main advantage of mounting the nozzles for rotation about an axis is that fewer nozzles are needed to spray a given area of the surface than was previously possible with devices in which the nozzles were fixed. Previous devices with fixed nozzles also require more cleaning fluid from the source to spray a given area with streams of the same velocity as those of the invention. With the invention, a carpet can be sprayed and cleaned in less time using fewer nozzles and less cleaning fluid than was formerly possible.

OBJECTS OF THE INVENTION

It is a principle object of the invention to provide a new and novel method and apparatus for cleaning hard and soft surfaces such as carpets, floors, streets, and the like using a cleaning fluid.

It is an object to provide a method and apparatus for loosening and removing soiling material from a surface such as a carpet by using a high velocity stream or streams of cleaning fluid and a vacuum source.

Another object is to provide a method and apparatus for applying high velocity streams of cleaning fluid to a surface using fewer nozzles than previous devices.

It is an object to provide a method and apparatus for applying high velocity streams of cleaning fluid to a surface using fewer and high velocity streams than previously possible.

It is an object of this invention to provide a method and apparatus for applying a cleaning fluid to a surface using a minimum of cleaning fluid from the source.

It is an object of this invention to provide a method and apparatus for reducing the time needed to apply a cleaning fluid in high velocity streams to a surface.

Other objects and features of this invention will become apparent by reference to the following specifications and to the drawings.

BRIEF DESCRIPTION OF THE DRAWINGS

FIG. 6 also shows the reaction force $F_R$ of the issuing streams on the nozzle as well as the component vectors ($S_y$, $S_z$, $F_y$, and $F_z$) of the vectors and $F_R$. In the embodiment of FIGS. 5 and 6, the third nozzle is moved in a direction H about the axis of rotation opposite to the direction N that its reaction force $F_R$ tends to move it.

DETAILED DESCRIPTION OF THE PREFERRED EMBODIMENTS

Figure 1:
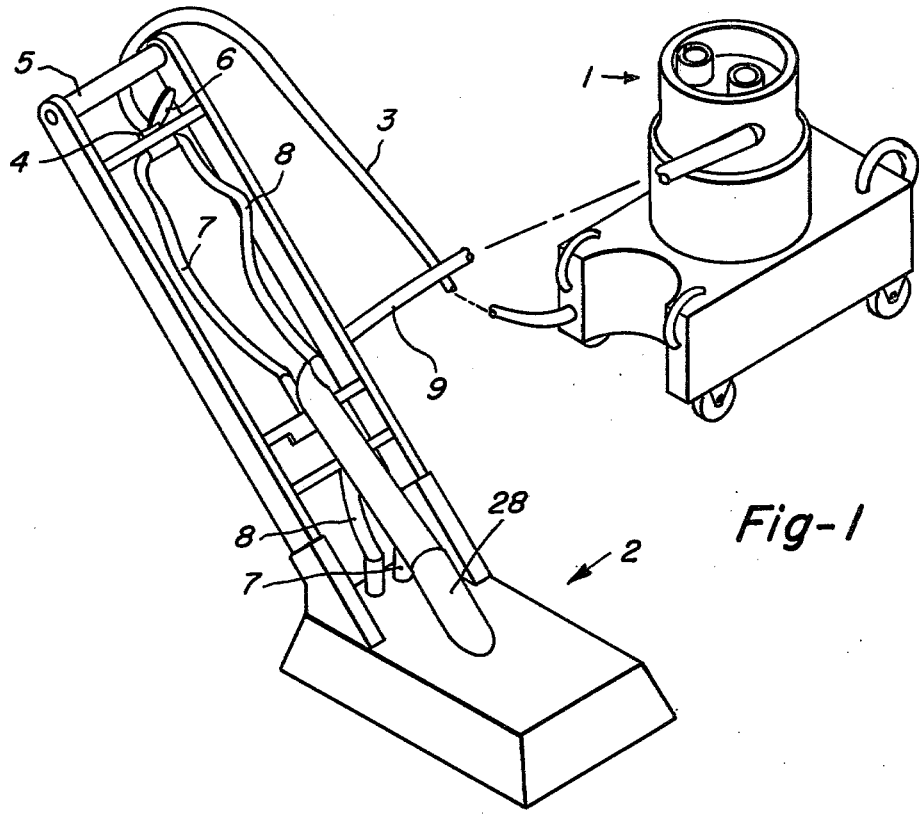
FIG. 1 is a perspective view of the invention showing the tank and floor tool.

As best seen in FIG. 1, the invention includes a tank 1 and a floor tool 2. The tank 1 is of conventional design and has a fluid compressor unit and vacuum unit. Cleaning fluid such as air, water, water with detergents or other cleaning material, and the like is added to the tank 1 and placed under a high pressure of about 200 to about 1,200 pounds per square inch by the compressor unit of the tank 1. The cleaning fluid under high pressure is fed from the tank 1 through line 3 to a valve 4 adjacent the handle 5 of the floor tool 2. Lever 6 of the valve 4 controls the flow of cleaning fluid into lines 7 and 8 of the floor tool 2. Lever 6 is movable to three positions. When the lever 6 is in a first position, the cleaning fluid flows into line 7 and when it is in a second position, the cleaning fluid flows into line 8. When the lever 6 is in the third position, the flow of cleaning fluid is shut off to both line 7 and line 8. The vacuum unit of the tank 1 places the line 9 from the floor tool 2 under pressure less than ambient.

Figure 2:
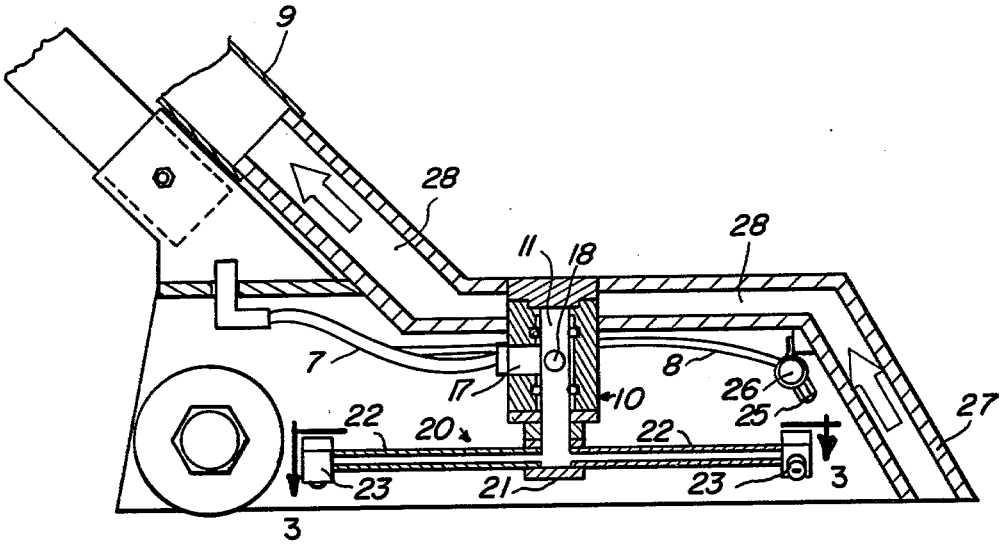
FIG. 2 is a cross-sectioned view of the floor tool.

As best seen in FIG. 2, line 7 is connected to the interior of cylindrical means 10 which supports the hollow means 11 for rotation about an axis substantially perpendicular to the surface to be cleaned. The cylindrical support means 10 has an inlet means at 17 and the hollow means 11 has inlet means 18 consisting of passages into the interior of the hollow means 11. The hollow means 11 in FIG. 2 has a substantially horizontal portion 20. The horizontal portion 20 has a hub member 21 and is shown to have two hollow members or arms 22 extending outwardly of the axis of rotation of the hollow means 11. Each hollow member 22 has an outlet nozzle means 23.

Figure 3:
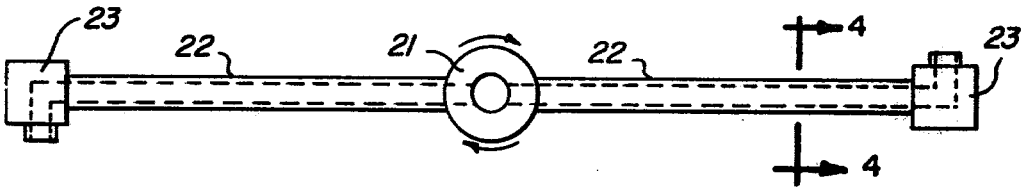
FIG. 3 is a view taken along line 3—3 of FIG. 2.
Figure 4:
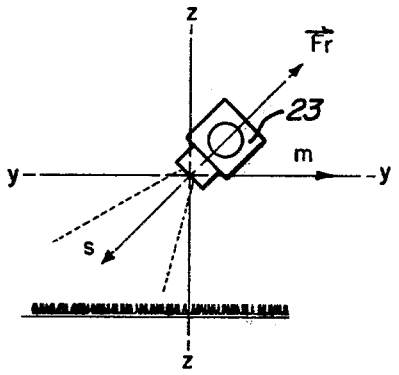
FIG. 4 is a view along line 4—4 of FIG. 3 illustrating the direction of the reaction force $F_R$ of the stream issuing from the nozzle and the direction M that the reaction force $F_R$ propels the nozzle about its axis of rotation.

As best seen in FIGS. 3 and 4, each outlet nozzle means 23 of this embodiment directs a stream of cleaning fluid at the carpet at an inclined angle to the carpet. The outlet nozzle means 23 are of conventional design. The stream of cleaning fluid issuing from each nozzle means 23 due to the high pressure alone of the source of cleaning fluid has a resulting vector S in FIG. 4 directed at the carpet. The reaction force $F_R$ on the nozzle means 23 due to the stream issuing therefrom is in the opposite direction of vector S. Since the nozzle means 23 is mounted for rotation about an axis substantially perpendicular to the carpet, the reaction force $F_R$ on the nozzle means 23 will tend to propel the nozzle means 23 in the direction M about the axis of rotation. For purposes of illustration, the stream vector S is shown to be in the y-z plane but can be in any direction outside of the plane that includes the axis of rotation. The reaction force $F_R$ of the nozzle means 23 will serve to rotate the hollow means 11 at a high angular velocity. This embodiment can have any number of hollow members or arms 22 extending outwardly of the hub member 21.

Figure 5:
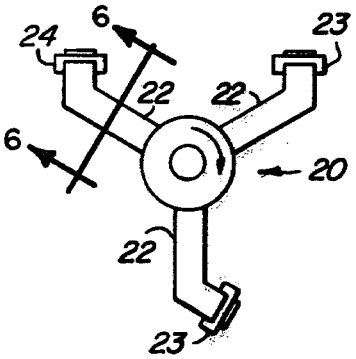
FIG. 5 is a view similar to FIG. 4 showing a nozzle arrangement in which two of the nozzles tend to rotate the hollow means about its axis in one direction and the third nozzle tends to rotate the hollow means about it's axis in the opposite direction. The third nozzle serves to control the revolutions per minute of the hollow means.
Figure 6:
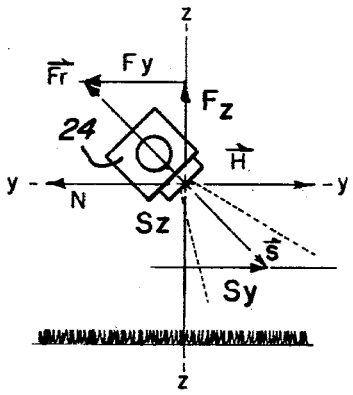
FIG. 6 is a view along line 6—6 of FIG. 5 showing the direction of movement H of the third nozzle and the direction of the streams issuing from the nozzle under the high pressure alone of the source of cleaning fluid.

FIGS. 5 and 6 illustrate a preferred embodiment in which the horizontal portion 20 of the hollow means 11 has a nozzle arrangement with three hollow members or arms 22. In this embodiment, two nozzle means 23 are directed at the surface to be cleaned so that the reaction force $F_R$ on each of the nozzle means 23 due to the stream issuing therefrom tends to propel the nozzle means 23 about the axis of rotation in a first direction. A third nozzle means 24 is directed at the surface to be cleaned so that the reaction force $F_R$ on nozzle 24 tends to propel it about the axis of rotation in a second direction opposite to the first direction. Comparing FIGS. 4 and 6, it can be seen that the reaction forces $F_R$ on the two nozzle means 23 tend to propel them in a first direction M while the reaction force $F_R$ on nozzle means 24 tends to propel it in a second direction N opposite to the first direction M. Each of the reaction forces are approximately the same in this embodiment and, consequently, the hollow means 11 is rotated about its axis in the direction determined by the two nozzle means 23, direction M in this case.

The result of the embodiment of FIGS. 5 and 6 is that nozzle means 24 is moved in the direction of vector H so that the velocity imparted to the stream of cleaning fluid by the moving nozzle means 24 adds to the existing velocity of the stream issuing from nozzle means 24 due to the high pressure alone of the source of the cleaning fluid. In other words, the vector of the moving nozzle means 24 (H in this case) is along the axis of a coordinate system in the same direction as a component vector ($S_y$ in this case) of the stream issuing from the nozzle means 24 due to the high pressure alone of the cleaning fluid source. In terms of the reaction force $F_R$, the vector H of the moving nozzle 24 is along an axis of a coordinate system in the opposite direction of a component vector ($F_y$ in this case) of the reaction force $F_R$ on the nozzle means 24 due to the stream issuing therefrom under the high pressure alone of the cleaning fluid source. These illustrations use a coordinate system in which vector H is directed along one axis, however, the same relationship holds true if one axis of the coordinate system is along the vector S. In that case, a component vector of vector H will be in the same direction as vector S or in the opposite direction of vector $F_R$. The coordinate systems of the above examples are instantaneous systems and move about the axis of rotation of hollow means 11 with the reference vector H or S or $F_R$ that defines an axis of the coordinate system. This moving of the nozzle means 24 so that the head portion of the stream where the high pressure cleaning fluid encounters ambient pressure is moved in the direction H produces a superior cleaning nozzle.

The angular velocity of the hollow means 11 about its axis of rotation in all of the embodiments can be adjusted by varying the angle of indication toward the surface of one or more of the nozzle means 23 and 24. In the embodiment of FIGS. 5 and 6, it is seen that nozzle means 24 acts as a brake for nozzle means 23 to reduce the revolutions per minute of the hollow means 11. The nozzle means 24 can also be directed vertically downward toward the carpet.

The invention also includes wall nozzles 25 which are spaced along a pipe 26 that is connected to line 8 as shown in FIGS. 1 and 2. When lever 6 is its second position, cleaning fluid under high pressure is fed to wall nozzles 25 through pipe 26 from line 8. The wall nozzles 25 spray an area right up against the vacuum manifold 27 in FIG. 2. In this manner, the floor tool 2 can clean an area of the carpet next to a wall.

The vacuum system of the invention includes the vacuum manifold 27 and pipe means 28 connected by line 9 to the vacuum unit of the tank 1 as best seen in FIGS. 1 and 2.

In operation, the fluid compressor unit and vacuum unit of the tank 1 are activated to place the cleaning fluid under high pressure of about 200 to about 1,200 pounds per square inch and to draw a vacuum through the floor tool's vacuum system of line 9, pipe means 28, and vacuum manifold 27. The high pressure cleaning fluid is fed from the tank 1 through line 3 to the valve 4 of the floor tool 2. Lever 6 is placed in its third position to prevent the cleaning fluid from entering line 7 or line 8. The floor tool 2 is moved to place the vacuum manifold 27 next to a wall or at the edge of the carpet. Lever 6 is then moved to its second position to feed high pressure cleaning fluid through line 8 and pipe 26 to the wall nozzles 25 and spray the area of the carpet next to the wall. Lever 6 is next moved to its first position to shut off the flow to the wall nozzles 25 and direct the flow of cleaning fluid to line 7. From line 7, the high pressure cleaning fluid enters the cylindrical support means 10 through the inlet means 17. The cleaning fluid passes into the hollow means 11 through inlet means 18 and issues from each outlet nozzle means 23 and 24 in a high velocity stream. The reaction force $F_R$ on each outlet nozzle means 23 in FIGS. 1–4 moves the hollow means 11 about its axis of rotation at a high angular velocity. The reaction forces $F_R$ on nozzle means 23 in the embodiment of FIGS. 5 and 6 determine the direction of rotation of the hollow means 11 and also move the hollow means 11 at a high angular velocity. In all of the embodiments, the floor tool 2 is pulled toward the operator away from the wall as it is moved over the carpet.

The outlet nozzle means 23 and 24 are about 7 to 12 inches from the axis of rotation. The reaction forces $F_R$ on the nozzles rotate the hollow means at about 600 to about 800 revolutions per minute so that the nozzle means 23 and 24 at about 150 to about 400 feet per second due to high pressure alone of the source of the cleaning fluid which is about 200 to about 1,200 pounds per square inch.

In the embodiment of FIGS. 5 and 6, nozzle means 24 is moved in a direction so that the velocity imparted to the stream due to the moving nozzle means 24 adds to the already high velocity of the stream issuing therefrom under the high pressure alone of the source of cleaning fluid.

In all of the embodiments, the angular velocity of the hollow means 11 can be adjusted by varying the angle of inclination of one or more of the nozzle means 23 and 24 toward the surface to be cleaned. All of the embodiments work particularly well on carpets. As the floor tool 2 is moved over the carpet, the streams of cleaning fluid issuing from each outlet nozzle means 23 and 24 strike the fibers of the carpet from virtually all directions to loosen any soiling material by breaking or dissolving any adhesive or electrostatic bonding between the soiling material and the carpet fibers.

The pressure and velocity ranges given are intended as mere examples. These ranges have been found to work particularly well when the invention is used to clean carpets. The invention has been operated at pressures above 1,700 pounds per square inch and angular velocity of above 1,500 revolutions per minute. The invention has also been operated at low pressures below 200 pounds per square inch and in systems in which the cleaning fluid is fed under pressure of about 30 to about 70 pounds per square inch or fed with a gravity feed. It is within the scope of this invention that the velocities and pressures could be increased or decreased beyond the ranges cited in the examples.

Although different embodiments and methods of this invention have been illustrated and described and variations thereof indicated, it will be understood that other embodiments may exist and that various changes may be made without departing from the spirit and scope of this invention.

We claim:

1. A method for cleaning hard and soft surfaces such as carpets, floors, streets, and the like by using three high velocity streams of cleaning fluid from a source under high pressure, said method comprising the steps of:

(a) placing the source of cleaning fluid under high pressure of about 200 to about 1,200 pounds per square inch, (b) forming three high velocity streams of about 150 to about 400 feet per second of cleaning fluid by exposing said high pressure source of cleaning fluid to ambient pressure through three nozzle means;

(c) mounting each of said three nozzle means for rotation about an axis substantially perpendicular to the surface to be cleaned and at a distance from said respective axis, (d) directing two of said nozzle means toward the surface to be cleaned at an inclined angle to said surface whereby said cleaning fluid under high pressure from said source issues in at least one stream from each of said two of said nozzle means toward said surface at an inclined angle thereto creating respective reaction forces on each of said two of said nozzle means which propel said three nozzle means about the respective axis of rotation in a first rotational direction at a high velocity relative to said surface, (e) directing the third of said nozzle means toward said surface at an inclined angle thereto in a direction creating reaction forces generally opposite to and substantially less than the combined reaction forces of said two of said nozzle means to effect a superior cleaning action, (f) moving the axis of rotation of each respective nozzle means relative to said surface, and, (g) subjecting the surface to be cleaned to pressure less than ambient.

2. An apparatus for cleaning hard and soft surfaces such as carpets, floors, street, and the like by using three high velocity streams of cleaning fluid from a source under high pressure, said apparatus comprising:

hollow means having inlet means, means to support said hollow means for rotation about an axis substantially perpendicular to the surface to be cleaned, said hollow means having three outlet nozzle means spaced from said axis of rotation, said support means supporting said hollow means with each of said outlet nozzle means directed toward the surface to be cleaned at an inclined angle to said surface, means to supply cleaning fluid under high pressure of about 200 to about 1,200 pounds per square inch to said hollow means through said inlet means whereby said cleaning fluid passes out of said hollow means through each of said outlet nozzle means in at least one high velocity stream of about 150 to about 400 feet per second directed toward said surface at the inclined angle of the nozzle means thereto creating respective reaction forces on each outlet nozzle means which tend to propel said nozzle means about said axis of rotation in a rotational direction, two of said nozzle means being inclined in a direction to create reaction forces in a common first rotational direction, the third nozzle means being inclined in a direction to create reaction forces in a second rotational direction and effect a superior cleaning action, the combined reaction forces of said two of said nozzle means being substantially greater that the reaction force of said third nozzle means to effect rotation of said hollow means in said first rotational direction, means to mount said support means and said axis of rotation of the hollow means for movement relative to said surface to be cleaned, and, means to subject said surface to pressure less than ambient.

* * * * *